US005423531A

United States Patent [19]

Hoshizaki et al.

[11] Patent Number: 5,423,531

[45] Date of Patent: Jun. 13, 1995

[54] HOCKEY STICK HANDLE

[76] Inventors: T. Blaine Hoshizaki, 183 Bedbrook, Montreal West, Quebec, Canada, H4X 1R7; Stephen D. Murphy, 699 Westheights Drive, Kitchener, Ontario, Canada, N2N 2Z6

[21] Appl. No.: 265,274

[22] Filed: Jul. 1, 1994

[51] Int. Cl.[6] ..... A63B 59/14

[52] U.S. Cl. ..... 273/67 A

[58] Field of Search ..... 273/67 R, 67 A, 735, 273/75; 81/489

[56] References Cited

U.S. PATENT DOCUMENTS

| | | | |
|---|---|---|---|
| 4,351,528 | 9/1982 | Duplin | 273/67 A |
| 4,358,113 | 11/1982 | McKinnon et al. | 273/67 A |
| 4,470,599 | 9/1984 | Usher, Jr. | 273/75 |
| 4,583,734 | 4/1986 | Pawlicki et al. | 273/73 J |
| 5,306,003 | 4/1994 | Pagotto | 273/67 A |
| 5,312,100 | 5/1994 | Ilacqua | 273/67 A |

FOREIGN PATENT DOCUMENTS

| | | | |
|---|---|---|---|
| 2472939 | 7/1981 | France | 273/73 J |
| 4019039 | 12/1991 | Germany | 273/73 J |
| 8900951 | 11/1990 | Netherlands | 273/67 A |

*Primary Examiner*—Mark S. Graham
*Attorney, Agent, or Firm*—R. Craig Armstrong

[57] ABSTRACT

A hockey stick handle being substantially rectangular in transverse cross section and has front and rear faces generally parallel to said faces of the blade, and narrower top and bottom faces being generally perpendicular to the faces of the blade, with the top face being on the same side of the handle as the blade. The rear face of the handle is convex, a central point on the rear face being at least 0.010" from the plane of outer edges of the rear face. A variant includes a concave front face. The hockey stick handle also has a significantly rounded corner between its top and rear faces providing superior ergonomic fit and enhanced control for the user.

8 Claims, 5 Drawing Sheets

HOCKEY STICK HANDLE

This invention relates to handles for hockey sticks made from wood or from composite materials.

Hockey stick handles are generally of rectangular cross section. Typically, the corners between the four sides of the handle are only slightly rounded and the sides themselves have substantially flat faces. This configuration is generally applied to both wood and composite stick handles.

There are several problems with the standard configuration for hockey stick handles. Little attempt has been made to modify this general shape to provide superior ergonomic fit with a player's hands or to improve the functionality and strength of the stick.

The game of hockey involves subjecting the stick and thus the player's hands to numerous impacts and torsion moments. For effective play these forces must be resisted, absorbed or dampened by the stick and/or by the player through his grip on the stick. Improving the shape and configuration of the stick handle can improve both player and stick performance as well as reducing repetitive strain type injuries (RSI).

Specifically, the rectangular shape of a hockey stick handle does not provide optimal resistance to bending moments of force that are encountered during a hockey game or practice. Lack of stiffness in the handle can cause excessive shaft flex. As a result, unnecessary breakage can occur causing additional cost for sticks and possibly compromising a player in competition.

A further result is that the energy transfer to the puck is decreased as additional energy is absorbed by the excessive shaft flexion. This can further impair the effectiveness of a player's performance by reducing the velocity of the shot.

The use of convex and/or concave design parameters is known to improve resistance to bending moments of force. While there have been some prior attempts to use convex and/or concave design parameters for hockey stick handles, these have involved either both of a handle's wide faces being convex, or both of a handle's wide faces being concave. These configurations have disadvantages as will be described below.

In the present invention, convex and/or concave faces are used in the wide faces of a hockey stick handle. The wide faces are not similar as these prior configurations achieve the mechanical strength advantage while compromising other aspects of stick performance. The present invention has been shown to improve handle strength and performance by improving resistance to the bending moments typically encountered in the game of hockey, while also improving stick ergonomics.

Further, there have been previous attempts to improve handle strength and performance by using composite materials. While successful to varying degrees these methods and materials are costly and obviously are not applicable to wooden handles which still form a large part of the market. In addition, these constructions do not include some of the other advantages as provided in the present invention, as will be described.

Another aspect of the typical rectangular configuration that has proven problematic has been the relatively "sharp" corners between the faces of the handle. This has been a problem with respect to all four corners but is particularly relevant with respect to the corner between the top face of the handle and the rear face of the handle. The top and rear faces of the handle correspond to the top and rear blade faces when a player holds a stick in the normal position for a forehand shot.

It is primarily through this corner (hereinafter defined as R1), and the rear face of the handle, that impacts on the stick are transferred to the player's hands, wrists and lower arms. It is the lower hand, closest to the blade which is most effected.

In anatomical terms, forces on the stick are transmitted from these specified handle areas to the hypothenar muscle group, the palmar aponeurosis, the flexor retinaculum, the distal end of the second and third metacarpals, and the proximal end of the second and third proximal phalanges.

The result is an ever increasing number of repetitive strain injuries (RSI) such as carpal tunnel syndrome. Carpal tunnel syndrome is an entrapment neuropathy involving the median nerve as it passes through the carpal tunnel. The symptoms can involve pain, discomfort, and impaired use of the hand. Stress and impact injuries and related soft tissue damage to players' wrists is also common.

To counteract these injuries it is desirable to disperse the impact forces which were previously concentrated in these anatomical areas.

As will be described, the present invention solves this problem in two primary ways. The first is to provide a significantly larger radius at R1 (corner between the top and rear handle faces) than has been previously seen. The second is to provide a generally convex rear handle face. These modifications assist with impact dispersion in the hypothenar muscle group, the palmar aponeurosis and the flexor retinaculum, as well as better dispersing forces on the metacarpals and phalanges. Both improvements also provide a unique feel and therefore performance due to the enhanced ergonomics of the stick visa visa player's hand.

A further problem with standard handle geometry is that it does little to assist the player in resisting rotation of the handle. The handle tends to rotate when force is applied to the blade as when the player strikes the puck, since the point of impact is offset from the axis of the handle. This force generates a moment about the longitudinal axis of the handle, thereby exerting torque on a player's hands, particularly the lower hand.

Resisting handle rotation can improve performance, particularly by improving the efficiency of energy transfer between the player and the puck.

One embodiment of the present invention improves the ability of a player to resist handle rotation by providing significantly larger than standard radii on the corners between the handles faces (in addition to R1) and further by providing a front handle face that is generally concave.

In view of the above, it is an object of the invention to provide an improved handle for a hockey stick having improved characteristics and providing better ergonomics thereby improving performance and reducing injuries to players.

Accordingly, in the invention, the hockey stick handle includes a top end and a blade end, the blade end being configured to receive a blade, the blade having front and rear faces. The handle is substantially rectangular in transverse cross section and has front and rear faces generally parallel to said faces of the blade, and narrower top and bottom faces being generally perpendicular to the faces of the blade, with the top face being on the same side of the handle as the blade. The rear face of the handle is convex, a central point on the rear face being at least 0.010" from the plane of outer edges of the rear face. A variant includes a concave front face.

Further features of the invention will be described or will become apparent in the course of the following detailed description.

In order that the invention may be more clearly understood, the preferred embodiment thereof will now be described in detail by way of example, with reference to the accompanying drawings, in which.

Figure 1:
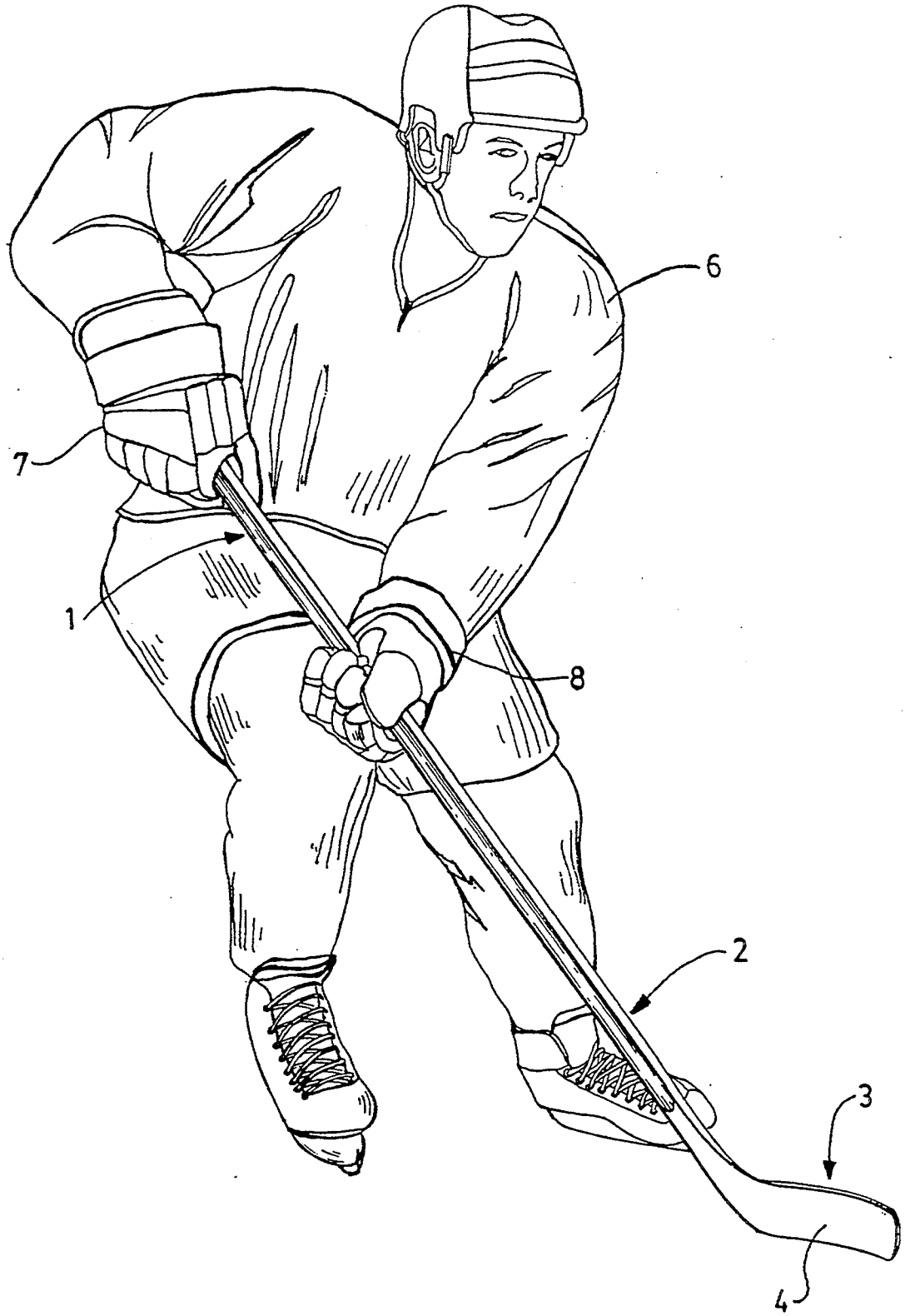
FIG. 1 is a perspective view of a hockey player holding a hockey stick with the handle of the present invention.

Referring to the drawings generally, a hockey player 6 is shown holding a hockey stick 1 which includes a handle 2 and a blade 3. The blade 3 includes a front blade face 4 and a rear blade face 5, the front face 4 being defined as the blade face that would be contacting the puck (not shown) in a forehand shot by the player 6. Conversely, the rear blade face 5 would normally be the blade face contacting the puck in a backhand shot.

For consistency all views of the player and of the stick are shown for a player that "shoots left" and who utilizes a left-handed stick. Referring to FIG. 1 therefore, the player 6 will typically have their left hand as the lower hand 8, gripping the stick 1 closest to the blade 3. The right hand will be the upper hand 7, gripping the stick at the top, furthest from the blade 3. It is the lower hand 8 that is most crucial, absorbing most of the impact and predominantly controlling the stick.

Figure 2:
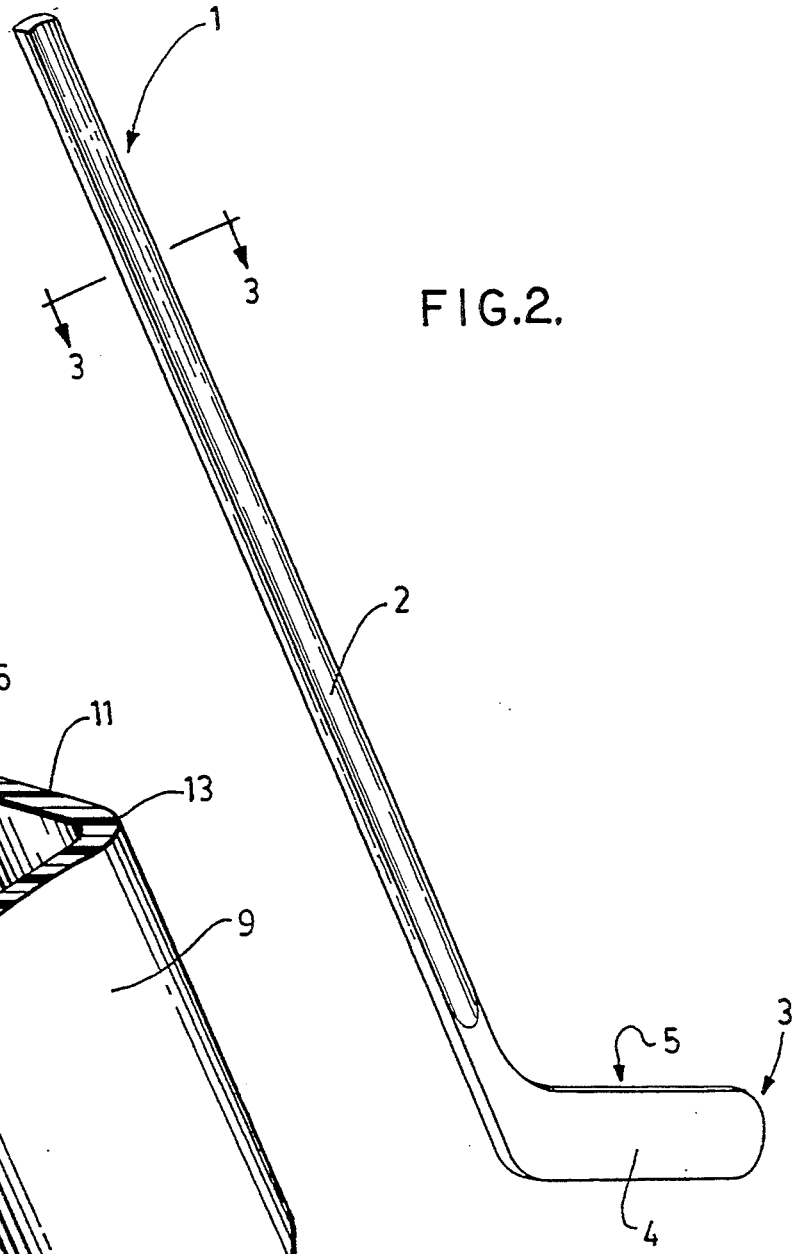
FIG. 2 is a perspective view of a hockey stick with the handle of the present invention.
Figure 3:
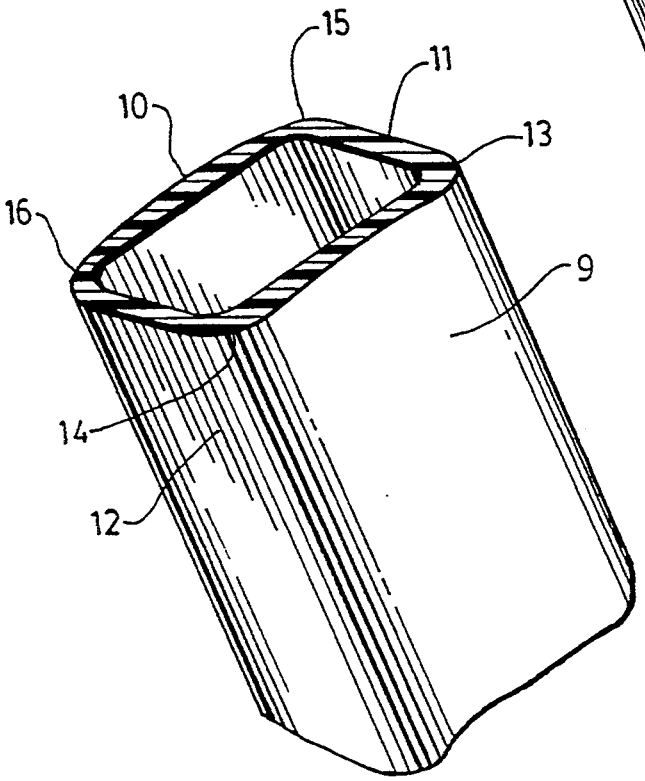
FIG. 3 is an enlarged sectional view of the hockey stick handle of the present invention constructed from composite material.

Referring to FIGS. 2 and 3, the handle 2 is shown to be elongated and generally of rectangular cross-section. The handle 2 includes a front handle face 9, a rear handle face 10, a top handle face 11, and a bottom handle face 12. The corners between the handle faces are defined as follows: the corner between the top face and the rear face is termed 15 and R1, the corner between the top face and the front face is 13, the corner between the bottom face and the rear face is 16, and the corner between the bottom face and the front face is 14.

Figure 4:
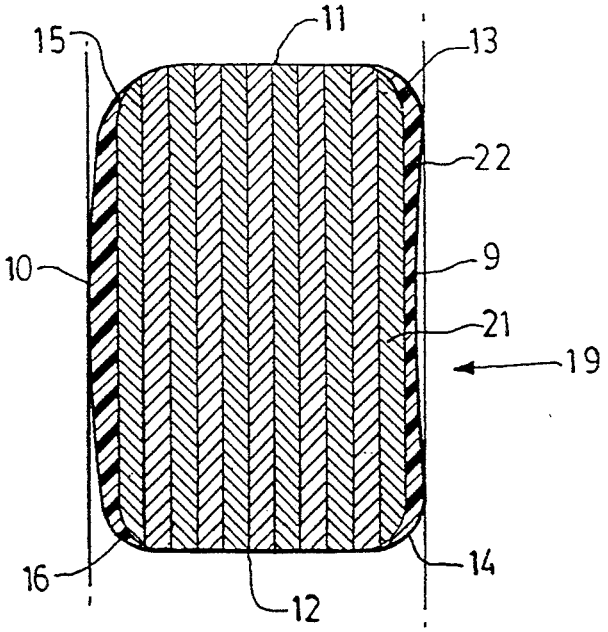
FIG. 4 is a cross-section of an embodiment of the handle fabricated from wood laminates coated in fibreglass, and having both a concave front face and a convex rear face.
Figure 5:
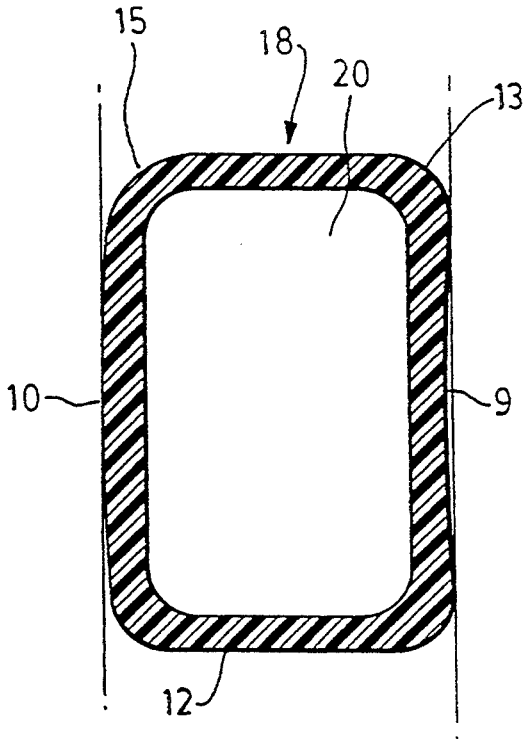
FIG. 5 is a cross-section of an embodiment of the handle fabricated from composite material and having a concave front face and a convex rear face.
Figure 6:
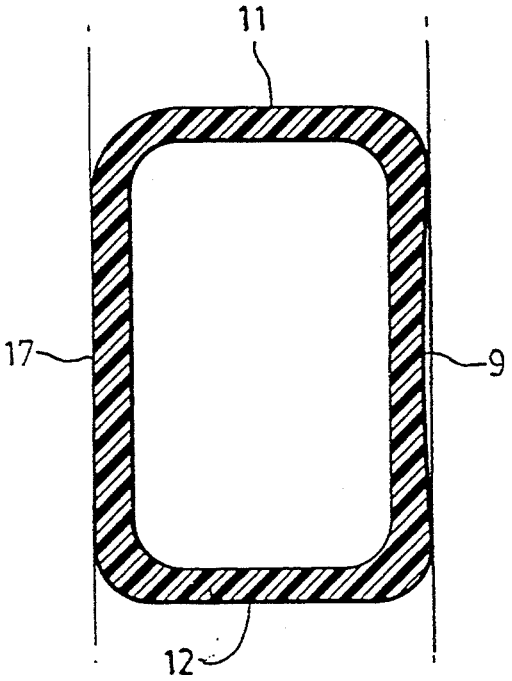
FIG. 6 is a cross-section of an embodiment of the handle fabricated from composite material and having a concave front face and substantially flat rear face.

Referring to FIGS. 4–6, differing combinations of front and rear handle faces 9 and 10, can be seen.

FIG. 4 depicts a sectional view of a wooden handle 19 showing the individual laminations 21 and an outer coating of fibreglass or the like 22. The front handle face 9 is shown as being concave, while the rear handle face 10 is shown as being convex. The top and bottom handle faces 11 and 12 are shown as being substantially flat.

The corners between the handle faces are all significantly more rounded than in many hockey stick handles. In particular, R1 is the corner with the largest radius.

Referring to FIG. 5, a composite hockey stick handle 18 is shown, having a solid or hollow core 20 and four sidewalls. The front face 9 is shown as concave and the rear face 10 as convex. Again all four corners have large radii, with R1 or 15, being the largest.

Referring to FIG. 6, another composite handle is shown. In this embodiment the front face 9 is again concave, however the rear face is different, being substantially flat 17. A slightly different embodiment of FIG. 6 (not shown) is a handle in which the rear face is convex, however the front face is different, being substantially flat.

In all of the embodiments in FIGS. 4–6, there is an optimum range of parameters of both the radii on the corners and the degree of convexity or concavity in the handle faces.

Specifically, it has been determined that the optimum range of radii for R1, or 15, is 2.5 to 7.0 mm, with a typical value being approximately 5.5 to 6.0 mm. The other three corners, being 13, 14 and 16 have been found to be most effective with radii of 2.5 to 6.0 mm., with a typical value for all three being approximately 4.0 mm.

Another embodiment involves having corner 13 having a radius inbetween the larger radius of R1 and the smaller radii of the bottom corners 14 and 16. Again, optimally R1 is about 5.5 to 6.0 mm, and bottom corners 14 and 16 remain at about 4.0 mm, but corner 13 has an intermediate value of approximately 4.5 to 5.0 mm.

Similarly, the degree of convexity in the rear face would be in a range of 0.010" to 0.030" as measured from a central point on the rear face to the plane formed by the outer edges of the rear face. A typical value is about 0.020".

The most effective range of concavity for the front face has been found to be similar, being from substantially flat, or 0.00", to about 0.030" as measured from a central point on the front face to the plane formed by the outer edges of the front face.

The above parameters have proven to be most effective in providing the impact dispersion and the strength and performance enhancements described above. These parameters do not adversely effect the ability of the player to control the stick as in stickhandling etc. which is one of the main reasons why rectangular as opposed to round shafts are used.

Figure 7:
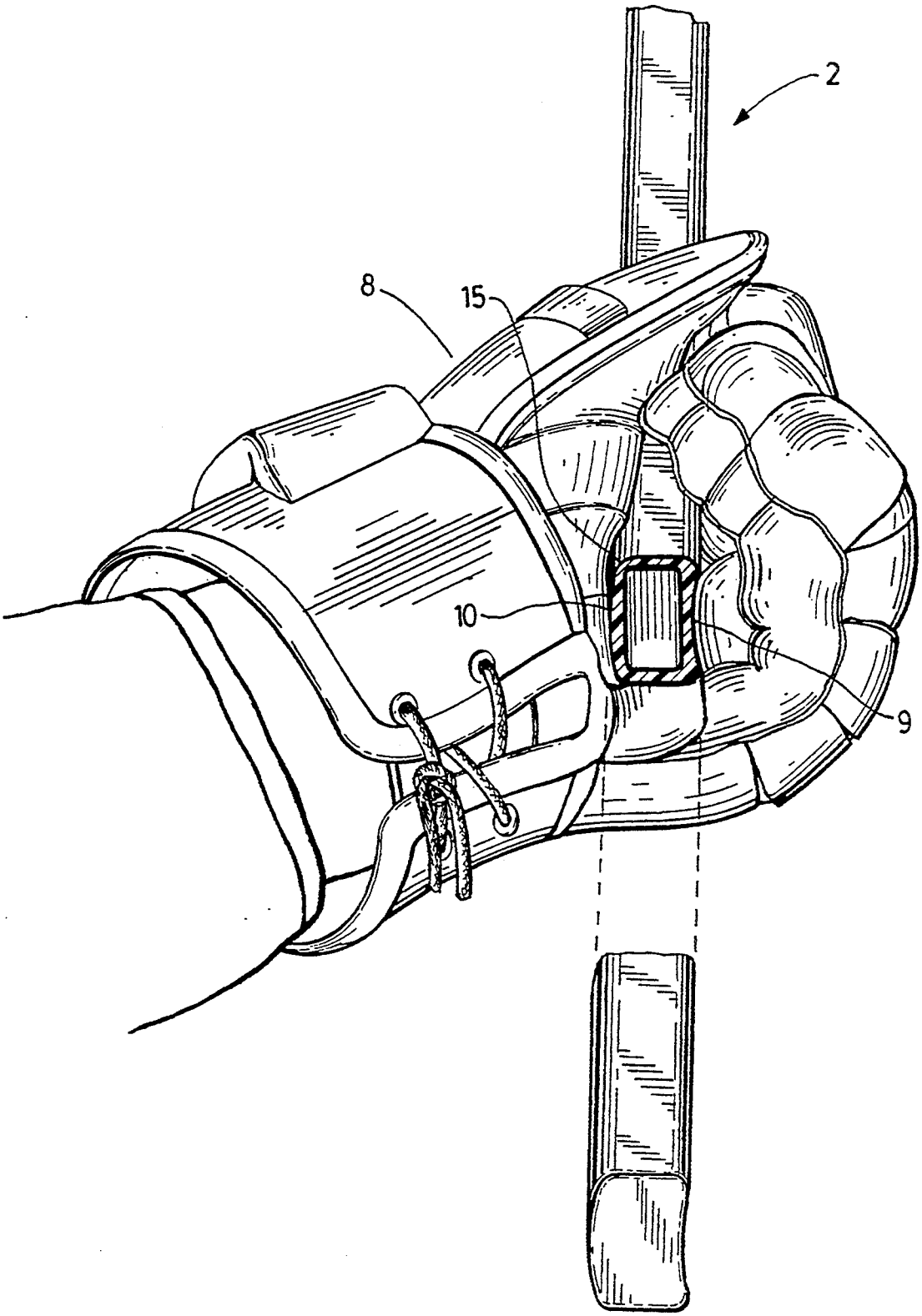
FIG. 7 is a close up perspective view of a hockey players bottom hand as it grips the handle.
Figure 8:
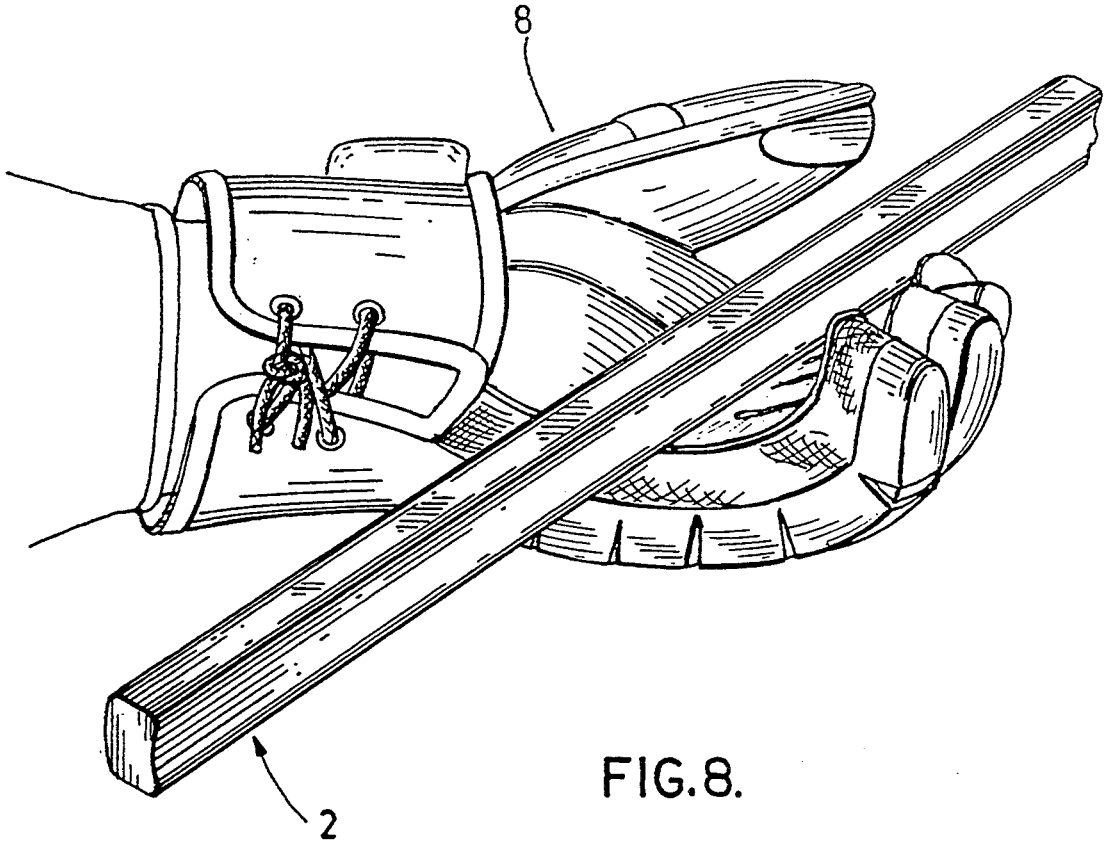
FIG. 8 is a perspective view of a hockey player's bottom hand as it releases from the stick handle.
Figure 9:
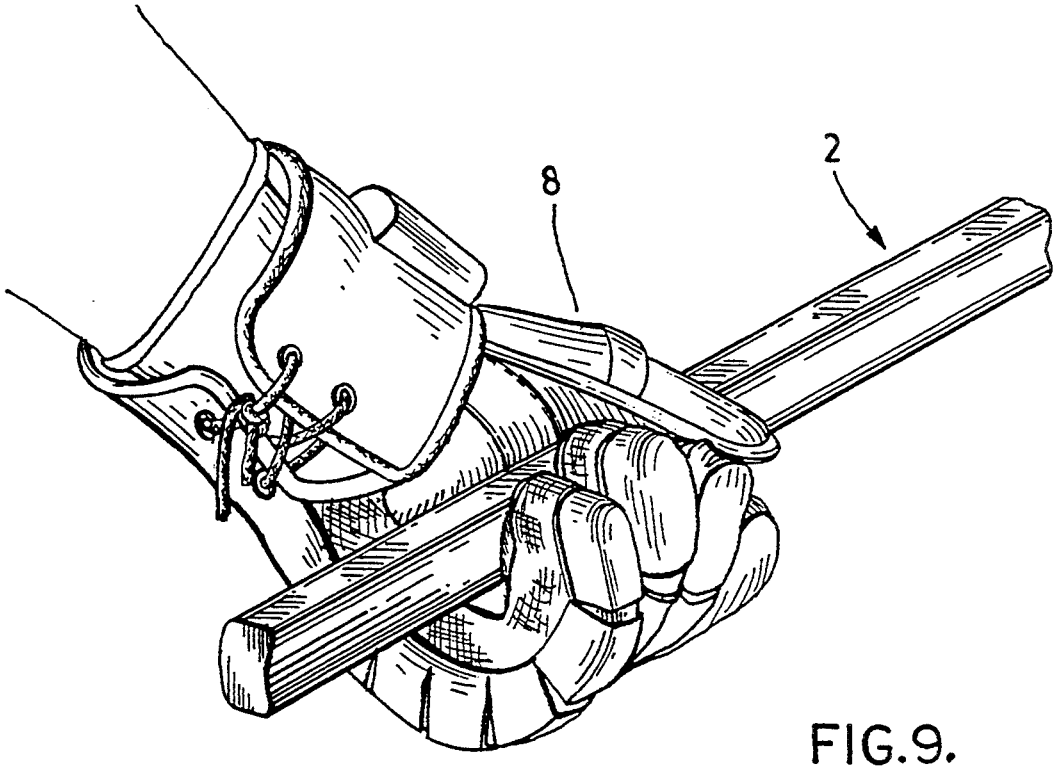
FIG. 9 is a perspective view of a hockey player's hand as it engages the stick handle.

FIGS. 7–9 show the handle of the present invention in close up as gripped by a player's lower hand 8. The natural curvature of the player's palm when gripping the stick can be seen to reciprocate well with the convex rear face 10.

Similarly, the concavity of the front face 9 can be seen to provide more surface area for contact with a player's fingertips, thereby providing better ability to resist rotation and improved feel for the player.

The advantages of having R1 with a larger radius can help reduce impact injuries at the juncture of the player's thumb and his hand, in the area of the hypothenar muscle group. Thus, together with the convex rear face, a larger surface area is provided by the handle of the present invention so as to aid in impact dispersion and to improve player feel and performance.

The present invention can be seen to be an improvement over earlier attempts at ergonomic sticks where in some cases just rounded corners were provided, or in other cases the front and rear faces were made both concave or convex. None of these configurations could provide all the benefits of the present invention. These earlier attempts to improve handle strength by using either two concave or two convex wide faces, actually compromise a player's grip, or alternately could exacerbate the injury risk to a player.

The embodiments of the invention in which an exclusive property or privilege is claimed are defined as follows:

1. A hockey stick handle having a top end and a blade end, said blade end being configured to receive a blade, said blade having front and rear faces, said handle being substantially rectangular in transverse cross section and having front and rear faces generally parallel to said faces of said blade, and narrower top and bottom faces being generally perpendicular to said faces of said blade, said top face being on the same side of the handle as said blade, where said rear face is convex, a central point of said rear face being at least 0.010" from the plane of outer edges of said rear face, and where said front face is concave, a central point of said front face being at least 0.010" from the plane of outer edges of said front face.

2. A hockey stick handle as recited in claim 1, wherein the maximum amount of concavity of the front face is in the range of 0.010 to 0.030" as measured from a central point of said front face to the plane of outer edges of said front face.

3. A hockey stick handle as recited in claim 1, wherein the amount of concavity of the front face is approximately 0.020" as measured from a central point of said front face to the plane of outer edges of said front face.

4. A hockey stick handle as recited in claim 1, wherein the corner between said handle's top and rear faces has a radius of at least 2.5 millimeters.

5. A hockey stick handle as recited in claim 1, wherein the corner between said handle's top and rear faces has a radius in the range of 2.5 to 7.0 mm.

6. A hockey stick handle as recited in claim 1, wherein the corner between said handle's top and rear faces has a radius of approximately 4.0 mm.

7. A hockey stick handle as recited in claim 1, wherein all of the corners between said handle's narrow and wide faces have a radius in the range of 2.5 to 7.0 mm.

8. A hockey stick handle as recited in claim 1, wherein all of the corners between said handle's narrow and wide faces have a radius of approximately 4.0 mm.

* * * * *